US011248315B2

(12) United States Patent
Stephan et al.

(10) Patent No.: US 11,248,315 B2
(45) Date of Patent: Feb. 15, 2022

(54) METHOD FOR OPERATING A SPINNING MACHINE, AND SPINNING MACHINE

(71) Applicant: Maschinenfabrik Rieter AG, Winterthur (CH)

(72) Inventors: Adalbert Stephan, Beilngries/Paulushofen (DE); Martin Zipperer, Beilngries (DE)

(73) Assignee: Maschinenfabrik Rieter AG, Winterthur (CH)

( * ) Notice: Subject to any disclaimer, the term of this patent is extended or adjusted under 35 U.S.C. 154(b) by 135 days.

(21) Appl. No.: 16/658,530

(22) Filed: Oct. 21, 2019

(65) Prior Publication Data

US 2020/0123681 A1 Apr. 23, 2020

(30) Foreign Application Priority Data

Oct. 22, 2018 (DE) ..... 10 2018 126 149.7

(51) Int. Cl.
*D01H 11/00* (2006.01)

(52) U.S. Cl.
CPC ..... *D01H 11/00* (2013.01)

(58) Field of Classification Search
None
See application file for complete search history.

(56) References Cited

U.S. PATENT DOCUMENTS 2,634,560 A * 4/1953 Ramm ..... B23Q 11/0057 451/456
2,976,556 A * 3/1961 Reiterer ..... D01H 11/005 15/301
3,777,329 A * 12/1973 Lane ..... D01H 4/36 15/301
3,839,764 A * 10/1974 Clayton ..... D01H 11/005 15/301
4,016,004 A * 4/1977 Koella, III ..... D01H 11/005 134/21
4,183,201 A * 1/1980 Stahlecker ..... D01H 4/36 57/301
4,505,101 A * 3/1985 Kurushima ..... D01H 4/36 15/301
5,454,219 A * 10/1995 Raasch ..... D01H 4/36 57/301
5,694,758 A * 12/1997 Anthony ..... D01H 4/36 57/301

(Continued)

FOREIGN PATENT DOCUMENTS

DE 26 34 770 A1 2/1978
DE 2658437 A1 * 6/1978 ..... D01H 4/36

(Continued)

OTHER PUBLICATIONS

German Patent Office Search Report, dated Oct. 9, 2019.
EPO Search Report, dated Jun. 4, 2020.

*Primary Examiner* — Khoa D Huynh
*Assistant Examiner* — Grace Huang
(74) *Attorney, Agent, or Firm* — Dority & Manning, P.A.

(57) ABSTRACT

A method for operating a spinning machine that has a plurality of adjacently arranged workstations and at least one trash conveying unit that transports trash accumulating at the workstations to at least one receiving unit includes discontinuously driving the trash conveying unit during operation of the spinning machine.

15 Claims, 2 Drawing Sheets

(56) References Cited

U.S. PATENT DOCUMENTS

| | | | | | |
|---|---|---|---|---|---|
| 5,809,766 | A | * | 9/1998 | Stahlecker | D01H 4/36 57/301 |
| 6,052,984 | A | * | 4/2000 | Summerer | D01G 15/64 19/236 |

FOREIGN PATENT DOCUMENTS

| | | | | | |
|---|---|---|---|---|---|
| DE | 198 27 610 | A1 | | 8/1999 | |
| DE | 102 22 012 | A1 | | 4/2003 | |
| DE | 10 2016 121 758 | A1 | | 5/2018 | |
| GB | 1419862 | A | * | 12/1975 | D01H 4/36 |
| GB | 1429559 | A | * | 3/1976 | D01H 4/36 |
| GB | 1474430 | A | * | 5/1977 | D01H 4/36 |

* cited by examiner

METHOD FOR OPERATING A SPINNING MACHINE, AND SPINNING MACHINE

FIELD OF THE INVENTION

The present invention relates to a method for operating a spinning machine comprising a plurality of adjacently arranged workstations and at least one trash conveying unit, wherein the trash conveying unit transports the trash accumulating at several of the workstations to at least one receiving unit.

Moreover, a spinning machine comprising a plurality of adjacently arranged workstations and at least one trash conveying unit is provided, wherein the spinning machine additionally comprises at least one receiving unit for trash transported by the trash conveying unit.

BACKGROUND

Modern spinning machines usually consist of a plurality of adjacently arranged workstations. Multiple operations are carried out at each of these individual workstations. For example, in a first step, a sliver is supplied to the workstation with the aid of a sliver supply and is separated into its individual fibers with the aid of an opening unit. In a next step, the separated fibers are then spun in a spinning rotor to form a yarn. In a subsequent operation, a downstream winding device winds the resultant yarn onto a package.

During all these work steps of a workstation, a certain amount of trash results, due to the method. In particular, it is unavoidable that, due to the sliver, trash and foreign material, such as shells and the like, enter the system or the workstation. This trash is removed in the region of the opening units of the workstations. In order to be able to ensure a proper production process at the workstations, it is known that a device is assigned to the spinning machine, with the aid of which the trash can be removed. Generally, the trash is transported to a receiving unit and, there, for example, is sucked up.

DE 102 22 012 A1, in which a conveying unit or a transport device is described, serves as an example of such a transport device. The device described therein is distinguished primarily by the fact that the conveying operation is adaptable, with the aid of a control unit, to the level of contamination or to the amount of trash on the transport unit. In this way, for example, given an elevated amount of trash, the transport speed can be automatically reduced, in order to ensure a reliable disposal of the trash. Additionally, it is described that the drive speed or the transport speed is divisible into two speed ranges. For example, a slide of the transport device can cleanly remove the accumulated trash at a first, higher speed. A second, lower speed ensures that all the material can be removed by a suction device. Due to the variable speed of the device, the reliable elimination of the trash is ensured.

In present-day spinning machines, not only functional aspects, but increasingly also energy-related aspects play a role, however. The problem addressed by the present invention is therefore that of refining the known prior art.

SUMMARY

The problem is solved by a method for operating a spinning machine, and a spinning machine having the features described herein.

The invention relates to a method for operating a spinning machine comprising a plurality of adjacently arranged workstations and at least one trash conveying unit, wherein the trash conveying unit transports the trash accumulating at several of the workstations from the plurality of workstations to at least one receiving unit.

According to the invention, it is provided that the trash conveying unit is discontinuously driven. Due to the discontinuous operation of the trash conveying unit, the reliable removal of the trash can be ensured and, nevertheless, energy can be saved, since the trash conveying unit does not run permanently. In addition, the service life of the trash conveying unit can be increased as a result, since, due to the discontinuous operation, the trash conveying unit operates for a shorter period of time overall.

It is therefore particularly advantageous when the trash conveying unit is maintained at a standstill during one or more of these downtimes, i.e., is not driven, and is driven during one or more operating times, i.e., moves in a direction, preferably in the direction of the at least one receiving unit. The downtime(s) and the operating time(s) of the trash conveying unit alternate periodically in this case, i.e., a downtime is followed by a moving time, and vice versa. Due to the utilization of this/these downtime(s), energy can be saved and, in addition, the wear of the individual components of the trash conveying unit is reduced, whereby the maintenance intervals and, therefore, the service life of the device are increased. In particular in the case of a small amount of trash, i.e., during times in which a small amount of trash accumulates, significant energy savings can be achieved with the aid of appropriately several or longer downtimes.

Moreover, it is advantageous when the trash conveying unit is driven during the operating time(s) according to a speed profile. A speed profile is understood to mean, in this case, that a drive speed of the conveyor belt is variably configurable throughout the operating time. A ramp function, for example, would be conceivable in this case, with the aid of which the trash conveying unit is accelerated and decelerated, wherein the ramp function can be utilized during the transition between a downtime and an operating time, and vice versa, as well as during an operating time. Other functions or speed profiles, both linear and non-linear, are also possible, of course. As a result, the trash conveying unit or its carrying capacity can be adapted to the parameters of the spinning machine, whereby an optimal conveyor output, i.e., the optimal removal of trash, can be achieved. It is conceivable, for example, to move the conveyor belt faster at the beginning of the operating time, in order to allow for a rapid removal of the trash, and to move the conveyor belt more slowly at the end of the operating time, in order to ensure the complete disposal of the trash by the receiving unit.

In this context, it is therefore also advantageous when the at least one receiving unit is designed as a suction unit and receives or sucks up the trash transported by the trash conveying unit. Spinning machines are usually equipped with a negative pressure system, which can also be utilized in this case for the receiving unit. The at least one receiving unit can be connected to a collecting container, in which the extracted trash is collected for disposal at a later time.

It is also advantageous when the at least one receiving unit, in particular the suction unit, is also brought to a standstill during the downtime(s) of the trash conveying unit. In this connection, the stoppage or the restart of the receiving unit can take place at the same time as or also delayed with respect to the stoppage or the restart of the trash conveying unit. Due to a later stoppage or an earlier start-up of the receiving unit, it can be ensured that the trash is optimally removed by the trash conveying unit. In addition, due to the stoppage of the receiving unit, energy is saved and the wear of the individual components of the receiving unit is minimized, whereby the maintenance intervals and, therefore, the service life are increased. If the receiving unit is designed as a suction unit, it can be closed, for example, with the aid of a flap. If multiple receiving units are associated with the trash conveying unit, it is advantageous when all these associated receiving units are brought to a standstill during the downtime(s) of the trash conveying unit.

It is advantageous when a particular duration of the operating time(s) and/or of the downtime(s) and/or the speed profile of the trash conveying unit and/or of the receiving unit(s) are/is adjustable. This makes it possible to orient the removal of the trash, for example, with respect to optimal removal performance or optimal energy consumption. In other words: The removal can be configured either for removing as much trash as possible or for operating using as little energy as possible. The duration of the downtime can also be varied, in this case, from downtime to downtime, which, incidentally, also applies for the operating time.

Moreover, it is advantageous when the particular duration of the operating time(s) and/or of the downtime(s) and/or the speed profile of the trash conveying unit are/is established depending on a present application and/or depending on a present amount of accumulating trash. This can take place automatically with the aid of a control system of the spinning machine or by an operator via an input. Preferably, the duration of the operating time(s) increases or the duration of the downtime(s) decreases if the amount of accumulating trash increases, and vice versa. Preferably, the speed profile of the trash conveying unit changes if the amount of accumulating trash changes, so that, if the amount of accumulating trash increases, preferably a higher speed is set, and vice versa. It is conceivable that a non-linear relationship exists between the amount of accumulating trash and the particular duration of the operating time(s) and/or of the downtime(s) and/or of the speed profile of the trash conveying unit. In other words: An increase of the amount of accumulating trash does not need to result in an increase, to the same extent, of the particular duration of the operating time(s) and/or of the speed profile. A present application can be, for example, the production of a certain yarn or, generally, the operation of the spinning machine using certain operating parameters. It is conceivable that the operating time(s) and/or the downtime(s) and/or the speed profile are/is managed within the scope of an article management.

It is also advantageous when the particular duration of the operating time(s) and/or the downtime(s) and/or the speed profile of the trash conveying unit is established and preferably automatically set by a control system of the spinning machine. The setting can take place once at the beginning of a lot as well as several times during the operation. "Automatically set" means, in this context, that the spinning machine automatically sets the duration of the operating time(s) and/or of the downtime(s) and/or the speed profile of the trash conveying unit ascertained or established for the particular application. Alternatively, the control system can also merely ascertain and display suitable values. The setting then takes place by an operator, who can track the proposed values or can also set other durations or can set another speed profile.

It is particularly advantageous when various durations of the operating time(s) and/or of the downtime(s) and/or various speed profiles are associated with various applications or various articles and are stored in a control system of the spinning machine, and are retrieved in order to establish the particular duration of the operating time(s) and/or of the downtime(s) and/or the speed profile.

Moreover, it is advantageous when an energy consumption of the trash conveying unit and/or of the receiving unit is determined and the durations of the operating time(s) and/or of the downtime(s) and/or the speed profile of the trash conveying unit are/is established depending on the energy consumption of the trash conveying unit and/or of the receiving unit. Preferably, this energy consumption-dependent control is designed in such a way that, in the case of an increase of the energy consumption of the trash conveying unit and/or of the receiving unit, a reduction of the duration of the operating time(s) of the trash conveying unit and/or of the receiving unit is carried out, wherein the reduction is, for example, so great, at most, that the trash can continue to be efficiently removed.

It is advantageous when a receiving capacity of the receiving unit is established depending on the amount of accumulating trash and/or on the speed profile of the trash conveying unit. Preferably, in the case of an increase of the amount of accumulating trash, the receiving capacity of the receiving unit is also increased, or in the case of a reduction of the amount, the receiving capacity is decreased. Preferably, in the case of a change of the speed profile of the trash conveying unit as well, a change of the receiving capacity of the receiving unit can take place, wherein the receiving capacity is increased in the case of an increase of the speed of the trash conveying unit, and vice versa. As a result, it is ensured that all the trash removed by the trash conveying unit can be accommodated by the receiving unit. In the case of a suction unit, the receiving capacity can be adapted, for example, by restricting the suction connection.

Moreover, it is advantageous when a distribution of the accumulating trash is determined and, on the basis of the distribution, a running direction and/or the speed profile of the trash conveying unit during the operating time is determined. The distribution of the trash within the trash conveying unit and/or at the workstations can be known in advance, for example, in case of multiple-lot occupancy, on the basis of the application. It can also be ascertained with the aid of a suitable sensor system. In this way, the quantity distribution of the trash along the entire length of the trash conveying unit is known. With the aid of the ascertainment and the adaptation of the running direction and/or of the speed profile, an optimization or shortening of the duration of the operating time(s) and, therefore, a reduction of the energy consumption and of the efficiency of the total system made up of the trash conveying unit and the receiving unit can take place.

It is also advantageous when the at least one receiving unit is brought to a standstill or is operated depending on the running direction of the trash conveying unit. Preferably, the receiving unit, in the direction of which the trash conveying unit moves, is operating. Due to the activation of only the receiving device located in the movement direction, additional energy can be saved. Moreover, the wear of the receiving unit or its drive is reduced.

It is advantageous when the trash conveying unit is moved, during the operating time, by an extent, which corresponds at least to the length of an entire machine longitudinal side. The conveyor belt of the trash conveying unit or, more precisely, a point of the conveyor belt located at one end of a machine longitudinal side, therefore runs once from one end of the machine longitudinal side to the opposite machine longitudinal side during an operating time. As a result, it can be ensured that the accumulated trash of all spinning stations of this machine longitudinal side is removed and is disposed of by the receiving unit.

Alternatively, it is also possible, however, to control the operating times of the trash conveying unit with respect to time. It is advantageous in this case when the operating time(s) is/are at least 10 seconds. Such a minimal operating time ensures, in the case of usual speeds of the conveyor belt, that the conveyor belt can move once from one end of a machine longitudinal side to the other machine longitudinal side.

Preferably, the duration of this/these operating time(s) is selected by the control system of the spinning machine and/or by the operator in such a way that the greater part of the trash, which has accumulated on the trash conveying unit, is conveyed to the receiving unit. As a result, it is ensured that the efficiency, i.e., the removal of the greatest possible amount of trash in the shortest possible duration of the operating time, is high. It also lies within the scope of the invention that the control system calculates a reasonable run time on the basis of machine data, such as the machine length and the speed of the conveyor belt.

An adjustable duration of the operating times can also be advantageous for the case in which the conveyor belt of the trash conveying unit does not comprise a scraper. Such scrapers brush against the lower edge of the opening units and, as a result, carry along any accumulated trash deposits. In this case, a reversal of the running direction of the conveyor belt is not absolutely necessary.

Moreover, it is advantageous when the downtime(s) is/are between 10 seconds and 240 minutes. Preferably, the duration of this/these downtime(s) is selected by the control system of the spinning machine and/or by the operator in such a way that the trash accumulates on the trash conveying unit without falling off the side of the trash conveying unit. As a result, it is ensured that the maximum amount of trash accumulates on the trash conveying unit before the removal of the trash is begun. As a result, the period of operation of the trash conveying unit is reduced to a minimum.

Moreover, a spinning machine comprising a plurality of adjacently arranged workstations and at least one trash conveying unit is provided, wherein the spinning machine additionally comprises at least one receiving unit for trash transported by the trash conveying unit.

According to the invention, it is provided that the spinning machine comprises at least one drive and at least one control system, which are designed for carrying out the method according to the preceding description.

BRIEF DESCRIPTION OF THE DRAWINGS

Further advantages of the invention are described in the following exemplary embodiments. Wherein.

DETAILED DESCRIPTION

Figure 1:
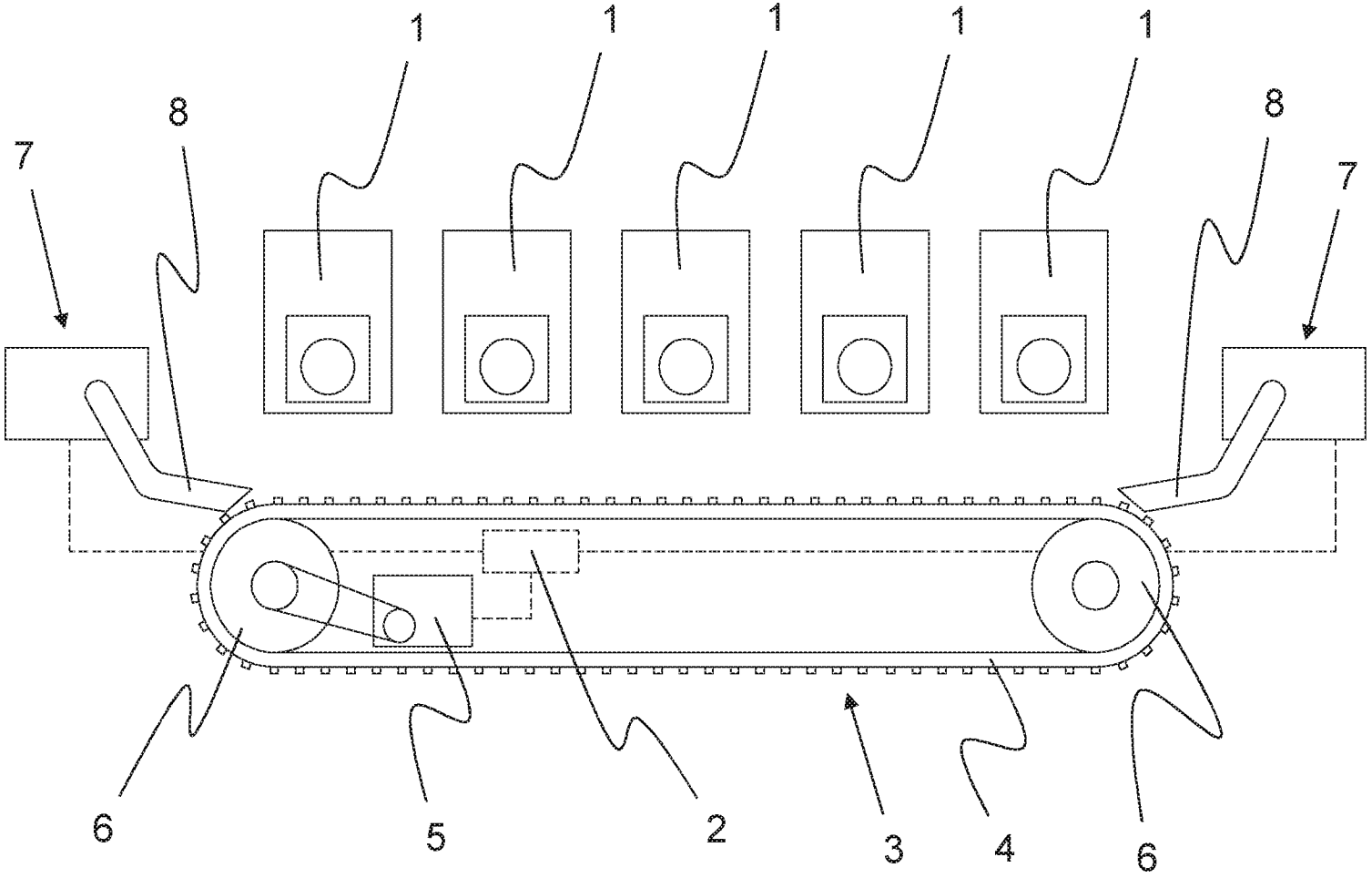
FIG. 1 shows a side view of a spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the figures, the same reference signs are utilized for features, which are identical and/or at least comparable in each of the various figures. The individual features, their embodiment and/or mode of operation are explained in detail usually only upon the first mention thereof. If individual features are not explained in detail once more, their embodiment and/or mode of operation correspond/corresponds to the embodiment and mode of operation of the features, which act in the same way or have the same name and have already been described.

FIG. 1 shows a schematic side view of a spinning machine comprising a plurality of adjacently arranged workstations 1, wherein these workstations 1 are controlled by a control system 2 of the spinning machine. In this example, a trash conveying unit 3 extends below the individual workstations 1, wherein this trash conveying unit 3 comprises a conveyor belt 4. The conveyor belt 4 is discontinuously driven by a drive 5, wherein the conveyor belt 4 can be moved, during an operating time, toward the left or the right, for example, in an oscillating or uniform manner, or according to a certain speed profile. A separately controllable receiving unit 7 in the form of a suction unit 8 is located on each of the two outer ends, i.e., at the reversal point 6 of the conveyor belt. A sensor system for detecting the amount of trash and the position of the trash on the trash conveying unit 3 is not represented.

A certain amount of trash results due to the operation of the workstations 1, in particular due to the opening of the sliver into individual fibers. The amount of trash is determined by the sliver cleanliness, i.e., the basic soiling of the sliver, as well as by the utilized technology and the set parameters thereof. In addition, the base material itself has a great effect on the amount of trash that arises during the spinning process.

The trash accumulating in the particular workstations 1 gradually drops in the direction of the floor during the spinning process, where it is received by the trash conveying unit 3, directly by the conveyor belt 4 in this case. Depending on the position and amount of the trash accumulated on the trash conveying unit 3, the control system 2 of the spinning machine determines at least the operating time(s) 9 (see FIG. 2) (or downtime(s) 12) of the trash conveying unit 3. If necessary, a running direction and/or a speed profile of the trash conveying unit 3 can also be determined. The control system 2 can therefore determine the most effective possibility for removing the trash. For example, the trash on the conveyor belt 4 is transported either to the left or the right in the direction of the suction units 8. The suction units 8 are also preferably automatically activated by the control system 2 of the spinning machine. If the trash, with the aid of the conveyor belt 4, then gets close to the suction unit 8, the trash is finally removed by the air flow of the suction unit 8.

Figure 2:
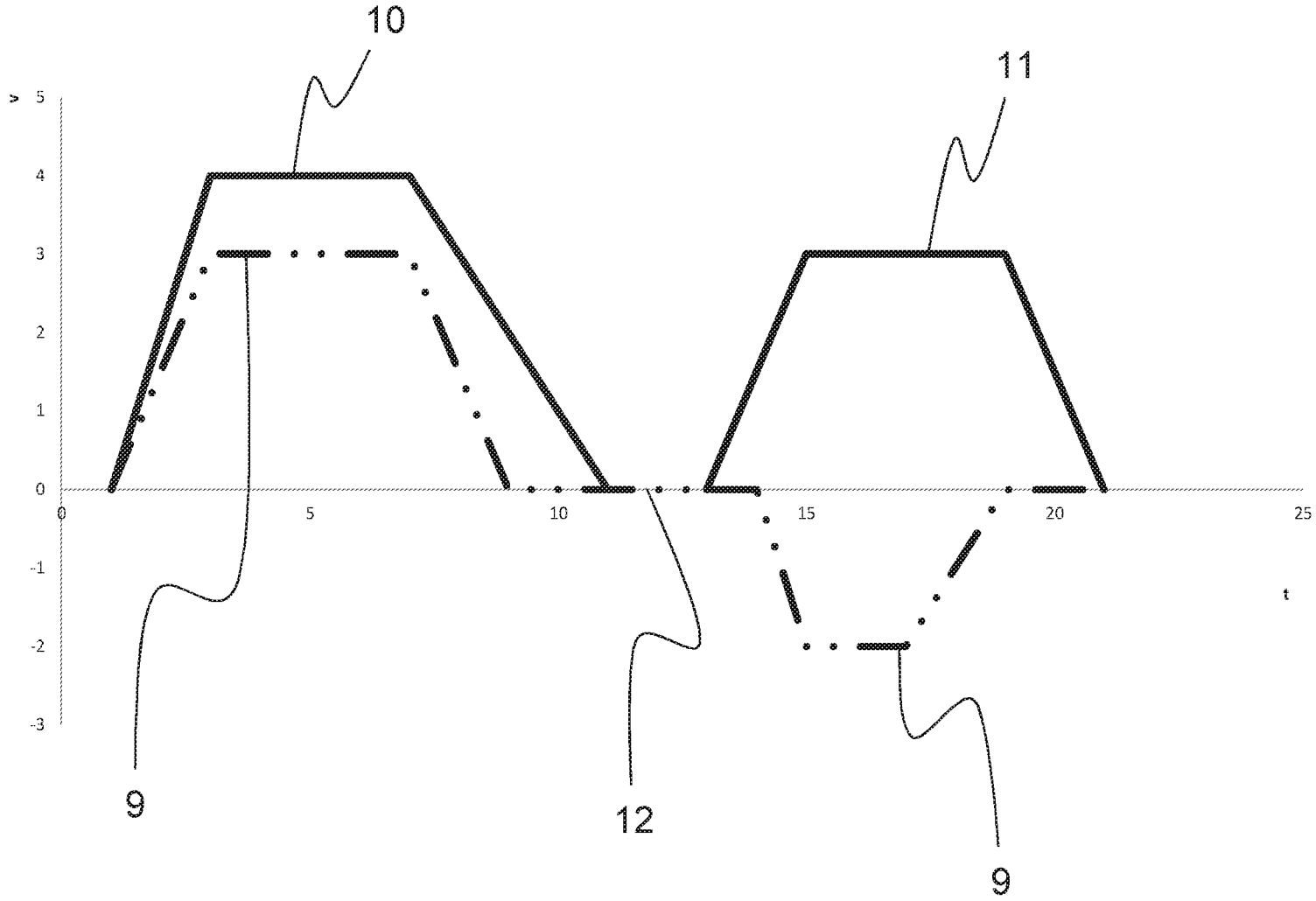
FIG. 2 shows a speed profile of a trash conveying unit and of a receiving unit.

FIG. 2 shows, by way of example, a speed profile and the (duration of the) operating time(s) and downtime(s) of a device according to FIG. 1 comprising a trash conveying unit 3 as well as two oppositely positioned receiving units 7 in the form of suction units 8. FIG. 2 shows an exemplary sequence of a trash removal operation based on two operating times 9 and a downtime 12 of the trash conveying unit 3, as well as an operating time 10, 11 of the receiving units 7, respectively. In the first operating time of the trash conveying unit 3, the drive 5 moves at a relative speed level of "3" in a first direction; this direction of rotation could result, for example, in a movement direction of the trash toward the right. Thereupon, the control system 2 of the spinning machine activates the first receiving unit 7 at the same time as the activation of the trash conveying unit 3 in the present case. In the present case, the receiving unit 7 is activated having a receiving capacity (in the example, a receiving capacity corresponding to the speed level "4") depending on the amount of transported trash, i.e., the greater the amount of trash, the greater the receiving capacity of the receiving unit 7 is. The suction intensity of the receiving unit 7 could also always be constant, of course, i.e., without the specification of a certain level.

After the trash has been largely removed from the trash conveying unit 3, the trash conveying unit 3 is gradually decelerated. In order to prevent trash from falling off the trash conveying unit 3, the receiving unit 7 is decelerated with delay and, therefore, continues to operate for a slightly longer period of time than the trash conveying unit 3. It is also conceivable, however, that the deceleration of the receiving unit 7 takes place at the same time as the deceleration of the trash conveying unit 3. After the deceleration of the two components, the two components are in a downtime 12.

After further trash has accumulated on the trash conveying unit 3, the trash conveying unit 3 and the second receiving unit 7 are activated by the control system 2 of the spinning machine, wherein the movement direction of the trash conveying unit 3 takes place counter to the first movement direction. This is represented by a negative speed level. In the present case, the second receiving unit 7 is still activated with delay with respect to the trash conveying unit 3, specifically before the trash conveying unit 3 in this case. Once a sufficient amount of trash has been removed from the trash conveying unit 3 by the second receiving unit 7, both components are brought to a standstill again, which also takes place with delay.

The described speed profile and the described downtimes and operating times are represented merely as examples. Of course, the downtimes and operating times of the trash conveying unit 3 can also remain the same upon every new activation and can be newly set only in connection with another application. The trash conveying unit 3 can also always be operated only at a single speed level, which incidentally also applies for the receiving unit(s) 7.

It is also conceivable that two or more consecutive operating times 9 have the same movement direction. A periodically fluctuating movement direction regardless of the position of the trash is also conceivable.

The extents traveled by the trash conveying unit 3 can also be different. According to an advantageous embodiment of the method, for example, the trash conveying unit 3 is moved once, during the operating time, completely from the first end of a machine longitudinal side to the second end. In this way, it can be ensured that the trash removed from all workstations 1 also actually reaches the first receiving unit 7 and can be disposed of there. The receiving unit 7 associated with the first end of the machine longitudinal side is active during the operating time.

A longer downtime 12 of the trash conveying unit 3 follows. This can be, for example, 10 minutes. Advantageously, both receiving units 7 are also brought to a standstill during the downtime. In this case, it can be advantageous when the duration of the downtime is adjustable, in order to be able to implement adaptations to various circumstances. Thereafter, the trash conveying unit 3 is reactivated and is moved in the other direction by an extent which, in turn, corresponds to the length of the entire machine longitudinal side, although at least corresponding to the length of all adjacently arranged workstations 1. At the same time, the receiving unit 7 positioned opposite the first receiving unit 7 is now set in operation. The first receiving unit 7 advantageously remains at a standstill and is reactivated only if—after a further, possibly adjustable downtime, during which preferably both receiving units 7 are brought to a standstill—the trash conveying unit 3 is reactivated and is moved in the first direction again.

The present invention is not limited to the represented and described exemplary embodiments. Modifications within the scope of the claims are also possible, as is any combination of the features, even if they are represented and described in different exemplary embodiments.

LIST OF REFERENCE NUMBERS

1 workstation
2 control system
3 trash conveying unit
4 conveyor belt
5 drive
6 reversal point
7 receiving unit
8 suction unit
9 operating time of the trash conveying unit
10 operating time of the first receiving unit
11 operating time of the second receiving unit
12 downtime

The invention claimed is:

1. A method for operating a spinning machine that has a plurality of adjacently arranged workstations and at least one trash conveying unit that transports trash accumulating at the workstations to at least one receiving unit, the method comprising:

discontinuously driving the at least one trash conveying unit during operation of the spinning machine;

maintaining the at least one trash conveying unit at a standstill during one or more downtimes and driving the at least one trash conveying unit during one or more operating times; and adjusting one or both of a duration of the one or more downtimes or a duration of the one or more operating times based on one or both of amount of trash accumulating or particular production application of the spinning machine.

2. The method as in claim 1, wherein the one or more downtimes and the one or more operating times follow one another in an alternating manner.

3. The method as in claim 2, wherein the at least one trash conveying unit is driven during the one or more operating times according to a speed profile.

4. The method as in claim 1, wherein the at least one receiving unit is a suction unit and the trash transported by the at least one trash conveying unit is sucked up by the suction unit.

5. The method as in claim 1, wherein the at least one trash conveying unit is driven during the one or more operating times according to a speed profile, and the at least one receiving unit is brought to a standstill during the one or more downtimes of the at least one trash conveying unit.

6. The method as in claim 5, wherein the speed profile of the at least one trash conveying unit is also adjustable based on one or both of the amount of trash accumulating or the particular production application of the spinning machine.

7. The method as in claim 6, wherein the duration of the one or more operating times, the duration of the one or more downtimes, or the speed profile of the at least one trash conveying unit are established by a control system of the spinning machine.

8. The method as in claim 1, wherein a receiving capacity of the at least one receiving unit is established depending on one or both of amount of accumulating trash and a speed profile of the at least one trash conveying unit.

9. The method as in claim 1, wherein a distribution of the accumulating trash is determined and one or both of a running direction and a speed profile of the at least one trash conveying unit during the one or more operating times is determined based on the distribution.

10. The method as in claim 1, wherein the at least one receiving unit is brought to a standstill or is operated depending on a running direction of the at least one trash conveying unit.

11. The method as in claim 1, wherein the at least one trash conveying unit is moved during the one or more operating times by an extent corresponding to the length of an entire machine longitudinal side of the spinning machine.

12. The method as in claim 1, wherein the one or more downtimes are between 10 seconds and 240 minutes and the one or more operating times are at least 10 seconds.

13. A spinning machine, comprising:

a control system configured to control the trash conveying unit in accordance with claim 1.

14. A method for operating a spinning machine that has a plurality of adjacently arranged workstations and at least one trash conveying unit that transports trash accumulating at the workstations to at least one receiving unit, the method comprising:

discontinuously driving the at least one trash conveying unit during operation of the spinning machine;

maintaining the at least one trash conveying unit at a standstill during one or more downtimes and driving the at least one trash conveying unit during one or more operating times;

adjusting a duration of the one or more operating times, a duration of the one or more downtimes, or the speed profile of the at least one trash conveying unit;

establishing the duration of the one or more operating times, the duration of the one or more downtimes, or the speed profile of the at least one trash conveying unit with a control system of the spinning machine; and wherein the duration of the one or more operating times, the duration of the one or more downtimes, or the speed profile of the at least one trash conveying unit are stored in and retrieved from the control system of the spinning machine.

15. The method as in claim 14, wherein the duration of the one or more operating times, the duration of the one or more downtimes, or the speed profile of the at least one trash conveying unit are established depending on energy consumption of one or both of the at least one trash conveying unit and the at least one receiving unit.

* * * * *